US011410519B2

(12) United States Patent
Hasan et al.

(10) Patent No.: US 11,410,519 B2
(45) Date of Patent: Aug. 9, 2022

(54) SYSTEMS AND METHODS FOR GENERATING HAZARD ALERTS USING QUANTITATIVE SCORING

(71) Applicant: General Electric Company, Schenectady, NY (US)

(72) Inventors: Sm Shajedul Hasan, Rexford, NY (US); Lembit Salasoo, Schenectady, NY (US); Cheng-Po Chen, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/952,407

(22) Filed: Nov. 19, 2020

(65) Prior Publication Data

US 2022/0157141 A1 May 19, 2022

(51) Int. Cl.
*G08B 21/00* (2006.01)
*G08B 21/02* (2006.01)
(Continued)

(52) U.S. Cl.
CPC ..... *G08B 21/02* (2013.01); *G06Q 50/08* (2013.01); *G08B 7/06* (2013.01)

(58) Field of Classification Search
CPC ..... G08B 21/02; G08B 7/06; G06Q 50/08
(Continued)

(56) References Cited

U.S. PATENT DOCUMENTS 8,085,144 B2 12/2011 Appelt et al.
9,792,798 B2 10/2017 Jobin et al.
(Continued)

FOREIGN PATENT DOCUMENTS

WO 2019046580 A1 3/2019
WO 2019084312 A1 5/2019
WO 2019244125 A2 12/2019

OTHER PUBLICATIONS

Podgorski et al., "Towards a conceptual framework of OSH risk management in smart working environments based on smart PPE, ambient intelligence and the Internet of Things technologies," dated 2017, International Journal of Occupational Safety and Ergonomics vol. 23, issue No. 1, pp. 1-20.
(Continued)

*Primary Examiner* — Naomi J Small
(74) *Attorney, Agent, or Firm* — Armstrong Teasdale LLP

(57) ABSTRACT

A system for generating hazard alerts is provided. The system includes a sensor unit including a plurality of sensors and a locating device and a hazard analyzing (HA) computing device configured to communicate with the sensor unit. The HA computing device includes a memory device and a processor configured to receive, from the plurality of sensors, a plurality of sensor measurements, receive, from the locating device, a plurality of sensor locations, determine, based on the received locations, a location of the sensor unit during each sensor measurement of the plurality of sensor measurements, compute, based on at least one of the plurality of sensor measurements and the determined locations, a plurality of sub-risk scores, compute a risk score based on the sub-risk scores, and determine that a first alert condition is present in response to the risk score being greater than a threshold risk score.

20 Claims, 4 Drawing Sheets

(51) Int. Cl.
*G08B 7/06* (2006.01)
*G06Q 50/08* (2012.01)

(58) Field of Classification Search
USPC ..... 340/540
See application file for complete search history.

(56) References Cited

U.S. PATENT DOCUMENTS

| | | | | |
|---|---|---|---|---|
| 10,032,352 | B2 | 7/2018 | Kozloski et al. | |
| 10,204,501 | B2 | 2/2019 | Chong et al. | |
| 10,261,061 | B2 | 4/2019 | Gowrisankar | |
| 10,282,957 | B1 | 5/2019 | Kirkbride | |
| 10,307,101 | B1 * | 6/2019 | Miller | A61B 5/0537 |
| 10,425,705 | B1 | 9/2019 | Manzella et al. | |
| 10,607,467 | B2 | 3/2020 | Kanukurthy et al. | |
| 10,885,759 | B1 * | 1/2021 | Lee | G08B 21/0453 |
| 11,181,893 | B2 | 11/2021 | Celia et al. | |
| 2007/0171042 | A1 | 7/2007 | Metes et al. | |
| 2014/0240088 | A1 | 8/2014 | Robinette et al. | |
| 2017/0011326 | A1 | 1/2017 | Liao et al. | |
| 2017/0169533 | A1 | 6/2017 | OBrien | |
| 2017/0193623 | A1 | 7/2017 | Garnavi et al. | |
| 2017/0206534 | A1 | 7/2017 | OBrien | |
| 2017/0245806 | A1 | 8/2017 | Elhawary et al. | |
| 2017/0289760 | A1 | 10/2017 | Sainfort et al. | |
| 2017/0302741 | A1 | 10/2017 | Conner | |
| 2017/0339741 | A1 | 11/2017 | K et al. | |
| 2018/0108236 | A1 | 4/2018 | Kanukurthy et al. | |
| 2018/0160943 | A1 | 6/2018 | Fyfe et al. | |
| 2018/0211345 | A1 | 7/2018 | Bean et al. | |
| 2018/0289095 | A1 | 10/2018 | Catterson et al. | |
| 2019/0073618 | A1 | 3/2019 | Kanukurthy et al. | |
| 2019/0122036 | A1 * | 4/2019 | Ward | G06Q 10/06398 |
| 2019/0149715 | A1 * | 5/2019 | Kraeling | H04N 5/23203 348/148 |
| 2019/0343429 | A1 | 11/2019 | Elhawary et al. | |
| 2019/0347597 | A1 | 11/2019 | Asendorf et al. | |
| 2020/0007741 | A1 * | 1/2020 | Johnson | H04N 5/23206 |
| 2020/0193341 | A1 | 6/2020 | Barak et al. | |
| 2020/0206928 | A1 | 7/2020 | Denenberg et al. | |
| 2021/0015415 | A1 * | 1/2021 | Ofir | A61B 5/1118 |
| 2021/0210202 | A1 | 7/2021 | Awiszus et al. | |
| 2021/0350312 | A1 | 11/2021 | Swift et al. | |

OTHER PUBLICATIONS

Corbellini et al., "A System for Monitoring Workers' Safety in an Unhealthy Environment by means of Wearable Sensors", 2008 IEEE Instrumentation and Measurement Technology Conference, Victoria, BC, pp. 951-955, May 12-15, 2008.

Wu et al., "Design and Implementation of a Wearable Sensor Network System for IoT-Connected Safety and Health Applications", 2019 IEEE 5th World Forum on Internet of Things (WF-IoT), Limerick, pp. 87-90, Apr. 15-18, 2019.

* cited by examiner

SYSTEMS AND METHODS FOR GENERATING HAZARD ALERTS USING QUANTITATIVE SCORING

BACKGROUND

The field of the invention relates generally to worksite monitoring systems, and more particularly, to systems and methods for generating hazard alerts using quantitative scoring.

Worksites and other locations may include various hazards that may not be visible or readily apparent to individuals at the site, but may be detected through the use of sensors. However, a single sensor measurement is generally insufficient to determine whether hazardous conditions are present, and if they are, to what degree the conditions pose a risk of danger or injury to individual workers. For example, if a portion of a power system is damaged or is malfunctioning, hot or electrically charged objects may be present in or near the system, which may pose a danger of burns, shock, or electrocution. Such charged objects cause an electric field to be present. Current sensors can detect the presence of an electric field by sensing an electric field magnitude at a particular location. However, a single measurement of an electric field magnitude is generally insufficient to determine whether the electric field source poses a danger to the worker, and to determine to generate an appropriate alert or warning for the worker.

An improved system for generating alerts based on worksite sensor measurements is therefore desirable.

BRIEF DESCRIPTION

In one aspect, a system for generating hazard alerts is provided. The system includes, at least one sensor unit including a plurality of sensors and a locating device. The system further includes a hazard analyzing (HA) computing device configured to communicate with the at least one sensor unit. The HA computing device includes at least one memory device and at least one processor. The at least one processor is configured to receive, from the plurality of sensors, a plurality of sensor measurements. The at least one processor is further configured to receive, from the locating device, a plurality of sensor locations. The at least one processor is further configured to determine, based on the received sensor locations, a location of the at least one sensor unit during each sensor measurement of the plurality of sensor measurements. The at least one processor is further configured to compute, based on at least one of the plurality of sensor measurements and the determined locations, a plurality of sub-risk scores, each sub-risk score of the plurality of sub-risk scores corresponding to a risk factor. The at least one processor is further configured to compute a risk score based on the sub-risk scores. The at least one processor is further configured to determine that a first alert condition is present in response to the risk score being greater than a threshold risk score.

In another aspect, method for generating hazard alerts is provided. The method is performed by a hazard analysis (HA) computing device including at least one processor coupled to at least one memory device and further coupled to at least one sensor unit including a plurality of sensors and a locating device. The method includes receiving, by the at least one processor from the plurality of sensors, a plurality of sensor measurements. The method further includes receiving, by the at least one processor from the locating device, a plurality of sensor locations. The method further includes determining, based on the received sensor locations, to a location of the at least one sensor unit during each sensor measurement of the plurality of sensor measurements. The method further includes computing, by the at least one processor, based on at least one of the plurality of sensor measurements and the determined locations, a plurality of sub-risk scores, each sub-risk score of the plurality of sub-risk scores corresponding to a risk factor. The method further includes computing, by the at least one processor, a risk score based on the sub-risk scores. The method further includes determining, by the at least one processor, that a first alert condition is present in response to the risk score being greater than a threshold risk score.

In another aspect, a hazard analysis (HA) computing device is provided. The HA computing device includes at least one processor coupled to at least one memory device. The HA computing device is configured to communicate with at least one sensor unit including a plurality of sensors and a locating device. The at least one processor is configured to receive, from the plurality of sensors, a plurality of sensor measurements. The at least one processor is further configured to receive, from the locating device, a plurality of sensor locations. The at least one processor is further configured to determine, based on the received sensor locations, a location of the at least one sensor unit during each sensor measurement of the plurality of sensor measurements. The at least one processor is further configured to compute, based on at least one of the plurality of sensor measurements and the determined locations, a plurality of sub-risk scores, each sub-risk score of the plurality of sub-risk scores corresponding to a risk factor. The at least one processor is further configured to compute a risk score based on the sub-risk scores. The at least one processor is further configured to determine that a first alert condition is present in response to the risk score being greater than a threshold risk score.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
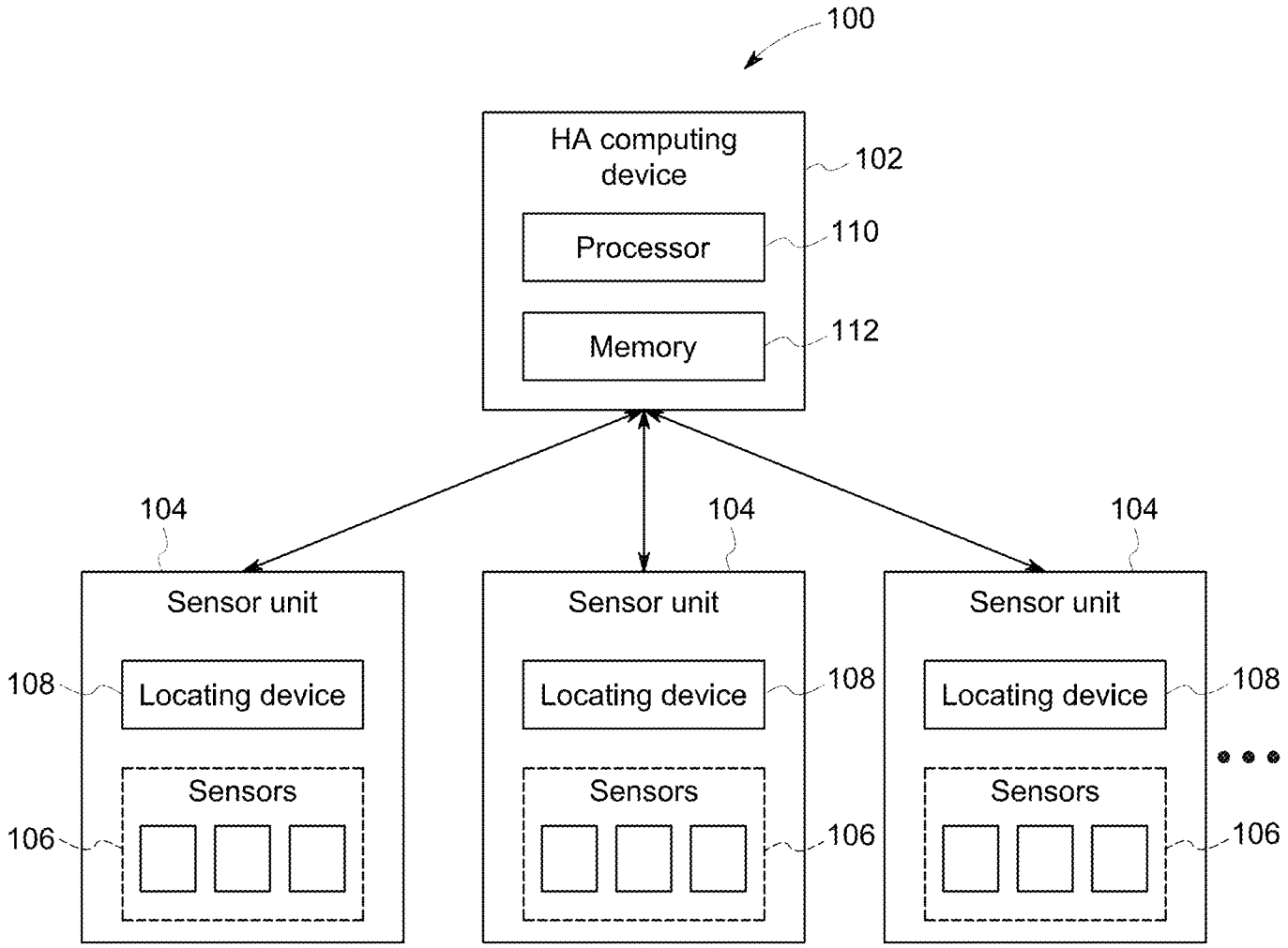
FIG. 1 is a block diagram of an exemplary hazard analysis (HA) system.

In the following specification and the claims, reference will be made to a number of terms, which shall be defined to have the following meanings.

The singular forms "a", "an", and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "about," "substantially," and "approximately," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

The embodiments described herein include a system for generating hazard alerts. The system includes at least one sensor unit including a plurality of sensors and a locating device. The system further includes a hazard analyzing (HA) computing device configured to communicate with the at least one sensor unit. The HA computing device includes at least one memory device and at least one processor. The at least one processor is configured to receive, from the plurality of sensors, a plurality of sensor measurements. The at least one processor is further configured to receive, from the locating device, a plurality of sensor locations. The at least one processor is further configured to determine, based on the received sensor locations, a location of the at least one sensor unit during each sensor measurement of the plurality of sensor measurements. The at least one processor is further configured to compute, based on at least one of the plurality of sensor measurements and the determined locations, a plurality of sub-risk scores, each sub-risk score of the plurality of sub-risk scores corresponding to a risk factor. The at least one processor is further configured to compute a risk score based on the sub-risk scores. The at least one processor is further configured to determine that a first alert condition is present in response to the risk score being greater than a threshold risk score.

While the system is described as being implemented in a worksite, in some embodiments, the system is implemented in other environments such as, for example, institutional environments (e.g., eldercare facilities, hospital, schools, or dormitories), recreational environments (e.g., gyms, walking and hiking trails, or swimming pools), sporting environments (e.g., training environments or game environments), commercial environments (e.g., offices, shopping centers and stores, airplanes, cruise ships, or ferries), in-home environments, military environments, livestock and pet environments, and other environments.

FIG. 1 is a block diagram of an exemplary hazard analysis (HA) system 100. HA system 100 includes an HA computing device 102 and one or more sensor units 104. HA computing device 102 is a central server that communicates with sensor units 104 situated, for example, throughout a worksite. As described in further detail below, HA computing device 102 uses data from the distributed sensor units 104 to generate scores (sometimes referred to herein as "sub-risk scores) that quantitatively represent danger of various corresponding hazards that may be experienced by a worker present in the work site. HA computing device 102 aggregates the sub-risk scores associated with a given worker or location into a single score (sometimes referred to herein as a "risk score") that quantitatively represents a level of risk for the worker or location at a given time. The sub-risk scores and risk score can be used to determine, for example, whether alerts should be sent to the worker, nearby workers, or supervisors. In some embodiments, HA computing device 102 and sensor units 104 communicate wirelessly, for example, using a wireless local area network (WLAN) or cellular connection, or through a direct wireless connection such as, for example, a Bluetooth or ZigBee connection. In some embodiments, HA computing device 102 is configured to communicate with sensor units 104 and other devices via a cloud network or non-cloud computer network. In some embodiments, HA computing device is configured to communicate with sensor units 104 using a personal internet-of-things (PIoT) standard, such a 3$^{rd}$ Generation Partnership Project (3GPP) standard that defines a protocol for communication between IoT devices (e.g., sensor units 104). In some such embodiments, the PIoT standard is a proprietary standard developed specifically for HA system 100 or similar systems.

Sensor units 104 include one or more sensors 106 and a locating device 108. Sensors 106 include one or more of various types of sensors such as, for example, cameras, gas sensors, temperature sensors, humidity sensors, voltage sensors, electric field sensors, biometric sensors, environmental sensors, sound sensors, pressure sensors, or other sensors that collect data corresponding to an environment of the location of sensor unit 104. Sensor units 104 are configured to transmit the data collected by sensors 106 (sometimes referred to herein as "sensor measurements") to HA computing device 102.

Locating device 108 is configured to determine a location of sensor unit 104 (sometimes referred to herein as a "sensor location") and an orientation of sensor unit 104. In some embodiments, locating device 108 is configured to use a radiolocation system such as, for example, a global positioning system (GPS), to triangulate a location of sensor unit 104 within the worksite. In some embodiments, locating device 108 includes a positional sensor that generates a pointing vector of sensor unit 104. The positional sensor includes a gyroscope or other device that enables locating device 108 to determine an orientation of sensor unit 104 such as, for example, a horizontal or vertical direction that sensor unit 104 is facing. In some embodiments, locating device 108 uses multiple technologies to determine the location of sensor unit 104. For example, GPS may be used for outdoor scenes, and ultra-wide-band technology may be used for accurate three dimensional positioning indoors. In some embodiments, locating device 108 utilizes additional sensors to determine a location of sensor unit 104. For example, locating device 108 may use a pressor sensor to determine an elevation of sensor unit 104, and a corresponding story of a floor of the worksite based on the elevation. Further, locating device 108 may include or be in communication with a proximity sensor that detects other sensor units 104 that are within a certain proximity of locating devices 108 or a relative proximity between locating devices 108 and the other sensor units 104, enabling nearby workers to be identified.

In some embodiments, at least some of sensor units 104 are wearable devices. For example, in some such embodiments, sensor units 104 are integrated into helmets or other personal protective equipment (PPE) worn by workers in the worksite, with sensors 106 being attached to or integrated into the wearable device. In such embodiments, each sensor unit 104 can include multiple sensors 106 of a given sensor type, which may increase an amount of data that can be collected by sensor unit 104 at a given time and may enable data collected by a single sensor unit 104 to determine, for example, a direction of a hazard source with respect to the sensor unit 104. Further, the wearable devices may include additional components such as, for example, loudspeakers and display screens, which can be used to generate and display alerts regarding hazards to the wearer.

Utilizing a greater number of sensors 106 that are, for example, located in a greater number of different positions increases the precision with which HA computing device 102 can quantify the hazard risk for a given location, the resolution at which HA computing device 102 can determine a generate a hazard map, and the accuracy with which HA computing device 102 identify the locations of potential hazards. Accordingly, in some embodiments, HA system 100 includes many sensor units 104 that are carried about the worksite by many different workers, enabling many field measurements to be taken relatively quickly throughout the worksite. While sensor units 104 are described herein as being wearable devices, in some embodiments, some or all of sensor units 104 are stationary installations. For example, in some embodiments, the worksite may include an array of sensors 106 installed throughout the worksite, each sensor 106 having a known location or coordinates.

HA computing device 102 includes a processor 110 and a memory device 112, which in some embodiments perform some or all of the functions described with respect to HA computing device 102. Memory device 112 is configured to store sensor measurements captured by sensors 106 of sensor units 104. In some embodiments, memory device stores additional information corresponding to sensor units 104 and workers and locations associated with sensor units 104. For example, in some embodiments, as described in further detail below, memory device 112 stores current, historical, or average risk scores or sub-risk scores associated with each sensor unit 104 or corresponding worker or location.

In some embodiments, memory device is further configured to store a reference map corresponding to a location monitored by HA system 100. The reference map includes a plurality of location identifiers that correspond to each of a plurality of locations of the worksite. In some embodiments, the location identifiers are location bins, or data structures defined to correspond to a certain area or space within the worksite. For example, in some embodiments, the reference map is an array of location bins that correspond to a specific two dimensional area or three dimensional space of the worksite. In some such embodiments, memory device 112 is further configured to store, for each location bin, current, historical, or average risk scores or sub-risk scores associated with each sensor unit 104 or corresponding worker or location.

HA computing device 102 is configured to receive, from sensors 106, a plurality of sensor measurements. In some embodiments, HA computing device 102 receives the sensor measurements simultaneously or continuously, intermittently, or periodically over a set period of time. Accordingly, a single worker wearing sensor unit 104 can capture a plurality of different sensor measurements, each from a different location within the worksite.

HA computing device 102 is further configured to receive, from locating devices 108, a plurality of sensor locations. Based on the received sensor locations, HA computing device 102 is further configured to determine a location of sensor unit 104 during each sensor measurement. For example, in some embodiments, each measurement may be transmitted to HA computing device 102 from sensor unit 104 in a data packet that includes the sensor measurement values for each measured parameter, a location of sensor unit 104 during the measurement, and other data such as, for example, an orientation of each sensor 106 during the measurement, and a timestamp or an identifier corresponding to the sensor unit 104 and/or sensor 106 from which the measurement originates. In some embodiments, when a sensor measurement is received, HA computing device 102 is further configured to interpolate a location corresponding to the sensor measurement based on one or more sensor location measurements received, for example, close to a time that the sensor measurement was received. In some embodiments, when a location measurement is received, HA computing device 102 is further configured to interpolate a sensor value corresponding to the location measurement based on one or more sensor value measurements received, for example, close to a location from which the location measurement was received. In some embodiments, HA computing device 102 is further configured to interpolate both a sensor value and a sensor location for another set of time instants. In some embodiments, HA computing device 102 is further configured to interpolate both a sensor value and a time instant for another set of locations.

HA computing device 102 is further configured to compute, based on, for example, the plurality of sensor measurements and the plurality of sensor locations, a plurality of sub-risk scores, each sub-risk score of the plurality of sub-risk scores corresponding to a risk factor. In some embodiments, HA computing device 102 computes the sub-risk scores based on received sensor measurements, determined sensor locations, or both. In some embodiments, the sub-risk scores may correspond to environmental risks (e.g., temperature, electric field, or gas) and/or health risks (e.g., high body temperature, high heart rate, or high blood pressure). The sub-risk scores are calculated based on one or more sensor measurements and other factors such as, for example, location or time of exposure to the risk. For example, as described below, in some embodiments HA computing device 102 is configured to determine a location of hazards in the worksite. HA computing device 102 may use a distance of the worker or sensor unit 104 from the location of a hazard when computing certain sub-risk scores. In some embodiments, HA computing device 102 is configured to determine, for each of the sub-risk scores, a risk category. For example, a sub-risk score may be categorized as one of safe, caution, extreme caution, danger, or extreme danger. The sub-categories are defined by thresholds that may be individually set for each worker based on factors such as, for example, ability, experience, or health. In some embodiments, HA computing device 102 is configured to compute the sub-risk scores in real time, such that the sub-risk score reflects a current risk of hazard of the worker or location associated with sensor unit 104.

HA computing device 102 is further configured to compute a risk score based on the sub-risk scores. For example, HA computing device 102 may aggregate, sum, take a weighted average of, or otherwise combine the sub-risk scores to generate a single quantity that reflects a risk of hazard to which a worker or location associated with sensor unit 104 is exposed. In some embodiments, a higher risk score may correspond to a greater hazard. Additionally or alternatively, in some embodiments, HA computing device 102 generates a safety score. In some such embodiments, the safety score is inversely related to the risk score, such that a higher safety score indicates that the worker or the location has a lower risk of hazard. In some embodiments, HA computing device 102 computes aggregate risk scores for a defined area or worksite based on risk scores associated with sensor units 104 located within the defined area or worksite. In some embodiments, HA computing device 102 is configured to compute the risk scores and/or safety scores in real time, such that the sub-risk score reflects a current risk of hazard of the worker or location associated with sensor unit 104.

HA computing device 102 is further configured to determine that an alert condition is present in response to the risk score being greater than a threshold risk score. In some embodiments, if the risk score for a given sensor unit 104 exceeds a threshold, HA computing device 102 further can transmit warning notifications to the corresponding worker or location. In some embodiments, sensor units 104 include a display screen or augmented reality (AR) device that displays information such as the risk score, the sub-risk scores, and warning notifications associated with the corresponding sensor unit 104. In some embodiments, sensor units 104 include a loudspeaker that emits a sound response to the warning notification. In some embodiments, HA computing device 102 transmits, for example, an email, text message, or other notification message to a smart phone associated with the identified workers. In some embodiments, HA computing device 102 transmits risk scores and corresponding alerts, for example, to a supervisor or to other nearby workers. In some embodiments, HA computing device 102 is further configured to determine if a given sub-risk score is greater than a threshold sub-risk score, and transmit a corresponding warning notification. For example, if a given worker has a temperature sub-risk score that exceeds a temperature sub-risk score threshold, HA computing device 102 may transmit a warning message to the worker indicating that the worker may be exposed to dangerous temperatures. In some embodiments, the risk score threshold and/or sub-risk score thresholds are individually set for each worker based on factors such as, for example, ability, experience, or health.

In some embodiments, HA computing device 102 is further configured to compute, for a given sensor unit 104 or for a given worker or location, average sub-risk scores, an average risk-score, and/or an average safety score over time active in the worksite. The average scores may be used by HA computing device 102 to determine, for example, alert thresholds or risk category thresholds for the worker or location. For example, HA computing device 102 may generate an alert if a risk score or sub-risk score deviates from the corresponding average risk score or sub-risk score by a threshold amount or percentage.

In some embodiments, HA computing device 102 is further configured to identify, for each sensor location, a location identifier. For example, in embodiments in which the reference map is broken down into an array of location bins corresponding to areas of the worksite, HA computing device 102 associates each sensor location with a location bin corresponding to a range of area of the worksite in which the sensor location falls. In some such embodiments, HA computing device 102 computes one or more of the sub-risk scores for a sensor unit 104 based on sensor measurements captured within a location bin where the sensor unit 104 is located. In some such embodiments, HA computing device 102 is configured to compute a sub-risk score, a risk score, and/or a safety score for each location bin.

In some embodiments, HA computing device 102 uses the sensor measurements and corresponding locations as data inputs to generate one or more maps of sensor measurements and corresponding hazard conditions throughout the worksite. For example, a regression analysis such as polynomial regression may be used to interpolate data points corresponding to sensor values at location identifiers that do not have a current corresponding sensor measurement from one of sensor units 104. Additionally or alternatively, HA computing device 102 may use other algorithms to generate a map of measured and interpolated sensor values throughout the worksite. In some embodiments, HA computing device 102 is in communication with, for example, a display screen, through which HA computing device 102 can display the generated map and the identified hazard conditions, for example, as an overlay on the generated map. In some embodiments, HA computing device 102 is configured to calculate the sub-risk scores further based on interpolated sensor values.

Figure 2:
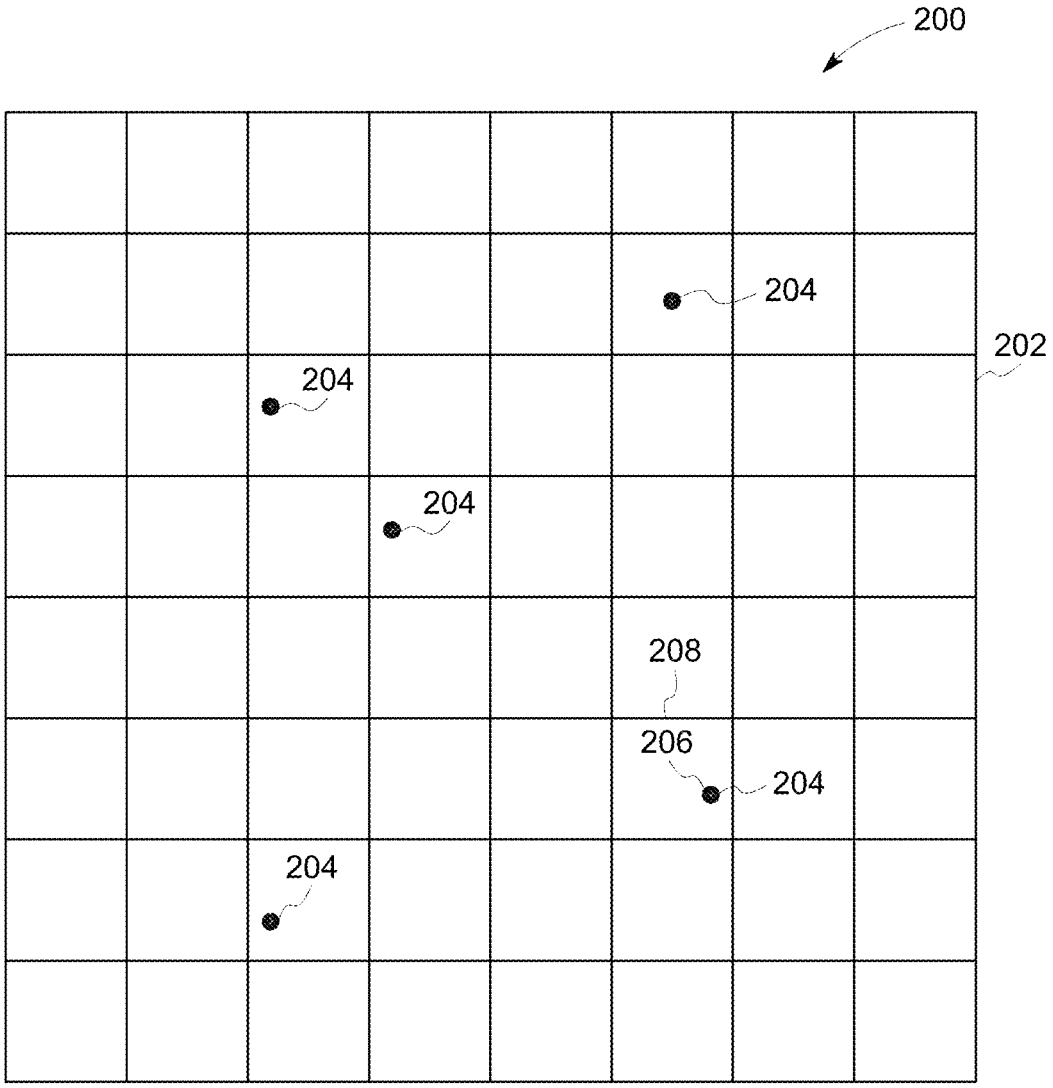
FIG. 2 is an exemplary reference map used by the HA system shown in FIG. 1.

FIG. 2 is an exemplary hazard map 200. In some embodiments, hazard map 200 is generated by HA system 100 (shown in FIG. 1), for example, using HA computing device 102. Hazard map 200 includes a plurality of location bins 202. Each location bin 202 corresponds to a specific area of a worksite. Each location bin 202 is associated with data such as, for example, one or more historical sensor values, sub-risk scores, or risk scores. For example, in some embodiments, each location bin 202 is associated with a first set of reference sensor levels that correspond to expected sensor values for the corresponding location under normal, non-hazard conditions, and one or more additional sets of reference sensor levels that correspond to expected sensor values for different hazard conditions. In such embodiments, each reference sensor level of a given set may correspond to, for example, a different measured parameter. In some embodiments, each location bin is associated with a set of sub-risk scores. In such embodiments, each sub-risk score, for example, a different measured parameter or combination of measured parameters.

As described above with respect to FIG. 1, sensor measurements are taken using one or more sensor units 104. Each measurement is taken at a corresponding sensor location 204. In some embodiments, to determine current hazard conditions, HA computing device 102 determines a location bin 202 that corresponds to each sensor location 204. For example, a first sensor location 206 is located within an area that corresponds to a first location bin 208, and accordingly, HA computing device 102 is configured to associate first sensor location 206 with first location bin 208.

Figure 3:
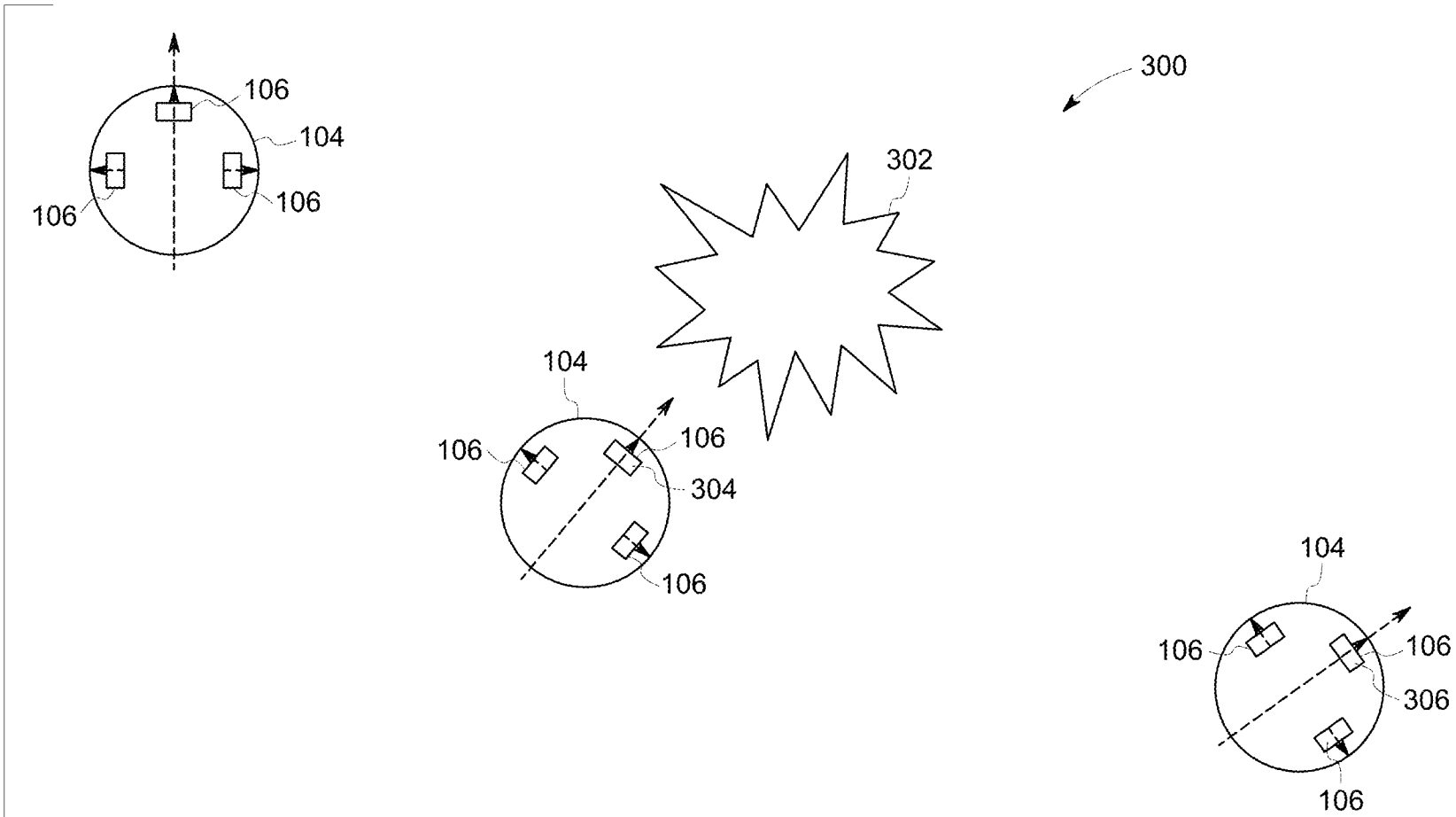
FIG. 3 is a plan view of an exemplary worksite in which the exemplary HA system shown in FIG. 1 is implemented.

FIG. 3 is a plan view of an exemplary worksite 300 in which HA system 100 (shown in FIG. 1) is implemented. Worksite 300 includes sensor units 104 including sensors 106, which generally function as described with respect to FIG. 1. In the example embodiment shown in FIG. 3, sensor units 104 are helmets worn by workers at worksite 300.

Worksite 300 includes a hazard source 302. Hazard source 302 may be, for example, a heat source such as a fire or overheating device, an electric field source, a source of fumes, or another source that results in effects detectable by sensors 106. Hazard source 302 generates effects in worksite 300 that may be measured or detected by sensors 106. For example, in embodiments where sensors 106 are electric field sensors, sensors 106 detect a specific electric field magnitude that depends on the location and orientation of sensor 106 with respect to hazard source 302. For example, a first sensor 304 that is located close to and oriented facing hazard source 302 may detect a relatively high electric field magnitude, while a second sensor 306 that is located farther away from and oriented perpendicular to hazard source 302 may detect a relatively low electric field magnitude.

Figure 4:
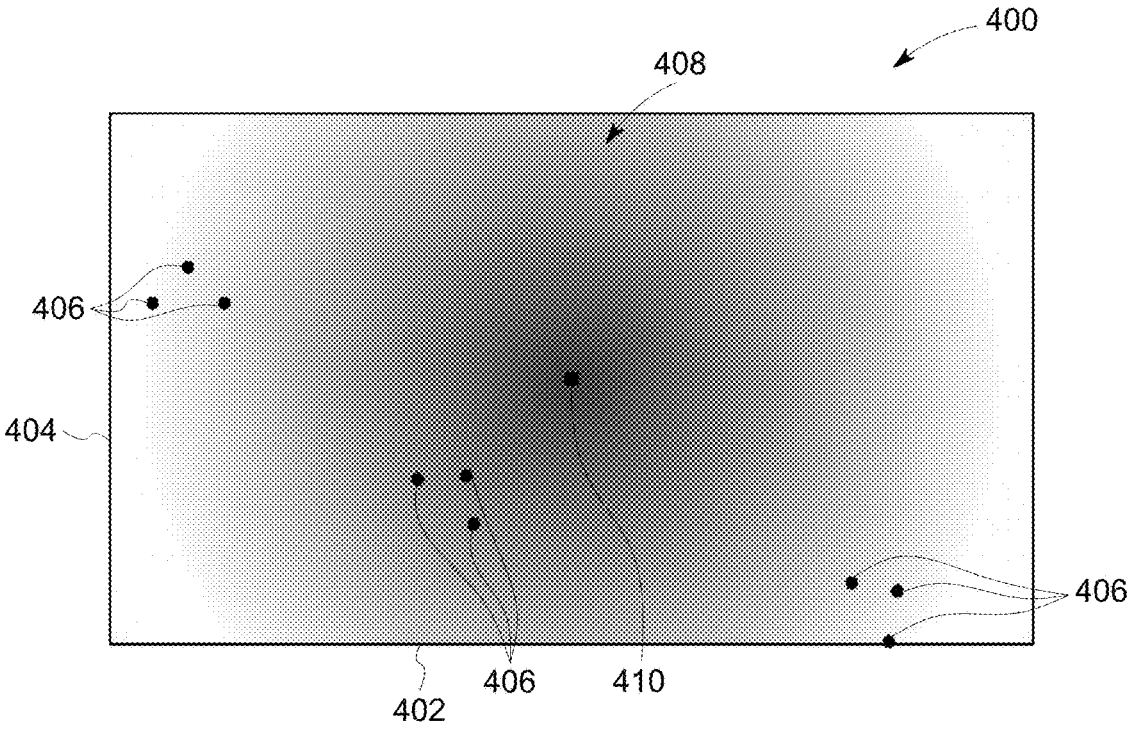
FIG. 4 is an exemplary hazard map representing a calculated magnitude of a hazard in the worksite illustrated in FIG. 3.

FIG. 4 is a hazard map 400 showing a calculated magnitude of a hazard in worksite 300 (shown in FIG. 3). For example, in some embodiments, hazard map 400 depicts an electric field magnitude, a temperature, or another parameter that can be measured in worksite 300 by sensors 106. In some embodiments, hazard map 400 is generated by HA computing device 102 (shown in FIG. 1). Hazard map 400 includes a horizontal axis 402 and a vertical axis 404 that correspond to a length along respective dimensions of worksite 300. For example, horizontal axis 402 may correspond to position in an east-west direction in meters or feet from a reference position, and vertical axis 404 may correspond to position in a north-south direction in meters or feet from a reference position.

Hazard map 400 further shows data points 406. Each data point 406 illustrates a position at which a measurement is taken with respect to horizontal axis 402 and vertical axis 404. While the locations of data points 406 correspond to the locations of sensors 106 shown in FIG. 3, in some embodiments, data points 406 are generated based on, for example, measurements from fewer sensors taken at different locations at different times. Each data point 406 also has a corresponding sensor measurement such as, for example, an electric field magnitude or temperature. As described with respect to FIG. 1, in some embodiments, HA computing device 102 is configured to use data points 406 to predict values that were not directly measured for the rest of worksite 300. Such predicted values are illustrated in FIG. 4 as a color gradient 408. Darker portions of color gradient 408 correspond to areas of greater magnitude values, while lighter portions of color gradient 408 correspond to areas of lesser magnitude values. A darkest portion of color gradient 408 is at a maximum value 410, which corresponds to hazard source 302 (shown in FIG. 3). For example, if hazard source 302 is an electric field source, an electric field magnitude will be greatest at maximum value 410. As such, the location of hazard source 302 may be determined using hazard map 400.

In some embodiments, HA computing device 102 is configured to generate a sub-risk score, for example, for an electric field risk for each worker based in part on a proximity of each worker to hazard source 302 and the magnitude of data points 406 and color gradient 408 corresponding to a location of each worker.

Figure 5:
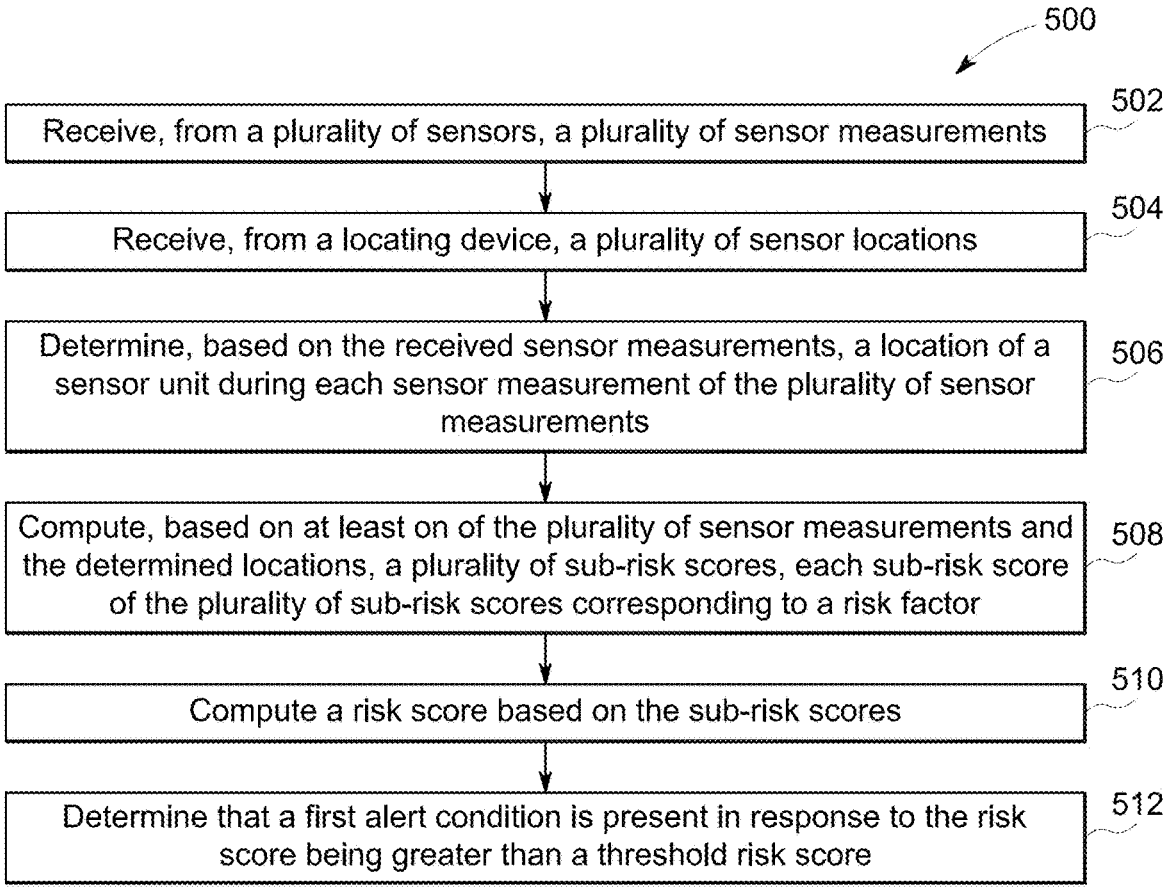
FIG. 5 is a flowchart of an exemplary method for mapping hazards.

FIG. 5 is a flowchart illustrating an exemplary method 500 for locating a hazard source. In some embodiments, method 500 is performed by HA system 100 (shown in FIG. 1), for example, using HA computing device 102.

Method 500 includes receiving 502, by at least one processor (such as processor 110) from a plurality of sensors (such as sensors 106), a plurality of sensor measurements. In some embodiments, the plurality of sensors is included in at least one sensor unit (such as sensor unit 104). In some embodiments, the plurality of sensors includes at least one of a camera, a gas sensor, a temperature sensor, a humidity sensor, a voltage sensor, an electric field sensor, a sound sensor, a pressure sensor, and a biometric sensor.

Method 500 further incudes receiving 504, by the at least one processor from a locating device (such as locating device 108), a plurality of sensor locations.

Method 500 further includes determining 506, based on the received sensor measurements, a location of the at least one sensor unit during each sensor measurement of the plurality of sensor measurements.

Method 500 further includes computing 508, by the at least one processor, based on at least one of the plurality of sensor measurements and the determined locations, a plurality of sub-risk scores. Each sub-risk score of the plurality of sub-risk scores corresponds to a risk factor.

Method 500 further includes computing 510, by the at least one processor, a risk score based on the sub-risk scores.

Method 500 further includes determining 512, by the at least one processor, that a first alert condition is present in response to the risk score being greater than a threshold risk score. In some embodiments, the at least one sensor unit further includes a wearable device, wherein the plurality of sensors are configured to be attached to the wearable device. In some such embodiments, the at least one sensor unit further includes a loudspeaker attached to the wearable device, and method 500 further includes causing, by the at least one processor, the loudspeaker to generate an audio notification based on a determination that an alert condition is present. In some embodiments, the at least one sensor unit further includes a display screen, and method 500 further includes causing, by the at least one processor, the display screen to display a notification based on the determination that an alert condition is present. In some such embodiments, method 500 further includes causing, by the at least one processor, the display screen to display at least one of the risk score and at least one of the plurality of sub-risk scores.

In some embodiments, method 500 further includes determining, by the at least one processor, that a second alert condition is present in response to a first sub-risk score of the plurality of sub-risk scores being greater than a threshold sub-risk score.

In some embodiments, method 500 further includes computing, by the at least one processor, an average risk score over time based on the computed risk score. In some such embodiments, method 500 further includes determining, by the at least one processor, that a second alert condition is present based on the computed risk score deviating from the average risk score by greater than a threshold deviation.

An exemplary technical effect of the methods, systems, and apparatus described herein includes at least one of: (a) generating a risk score that summarizes a safety condition of a worker or location by computing a plurality of sub-risk scores corresponding to different risk conditions based on sensor measurements and computing the risk score based on the plurality of sub-risk scores; (b) determining a current category of risk of a worker by computing a risk score for the worker based on sensor measurements; (c) generating individualized risk scores for workers by setting alert thresholds based on attributes of the individual worker and by computing a risk score based on sub-risk scores wherein the sub-risk scores are weighted based on relative importance; (d) determining that alert conditions are present by comparing current risk scores to historical risk scores; and (e) generating real time alerts by computing a risk score in real time based on current sensor measurements.

Exemplary embodiments of a system for generating hazard alerts using quantitative scoring are provided herein. The systems and methods of operating and manufacturing such systems and devices are not limited to the specific embodiments described herein, but rather, components of systems and/or steps of the methods may be utilized independently and separately from other components and/or steps described herein. For example, the methods may also be used in combination with other electronic systems, and are not limited to practice with only the electronic systems, and methods as described herein. Rather, the exemplary embodiment can be implemented and utilized in connection with many other electronic systems.

Some embodiments involve the use of one or more electronic or computing devices. Such devices typically include a processor, processing device, or controller, such as a general purpose central processing unit (CPU), a graphics processing unit (GPU), a microcontroller, a reduced instruction set computer (RISC) processor, an application specific integrated circuit (ASIC), a programmable logic circuit (PLC), a field programmable gate array (FPGA), a digital signal processing (DSP) device, and/or any other circuit or processing device capable of executing the functions described herein. The methods described herein may be encoded as executable instructions embodied in a computer readable medium, including, without limitation, a storage device and/or a memory device. Such instructions, when executed by a processing device, cause the processing device to perform at least a portion of the methods described herein. The above examples are exemplary only, and thus are not intended to limit in any way the definition and/or meaning of the term processor and processing device.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system for generating hazard alerts, said system comprising:

a plurality of sensor units each comprising a plurality of sensors and a locating device; and a hazard analyzing (HA) computing device configured to communicate with said plurality of sensor units, said HA computing device comprising:

at least one memory device; and at least one processor, wherein said at least one processor is configured to:

receive, from said plurality of sensors of each of said plurality of sensor units, a plurality of sensor measurements;

receive, from said locating device of a first sensor unit of said plurality of sensor units, a plurality of sensor locations;

determine, based on the received sensor locations, a location of said first sensor unit during each sensor measurement of the plurality of sensor measurements;

compute, based on the plurality of sensor measurements received from each of said plurality of sensor units and the determined locations for said first sensor unit, a plurality of sub-risk scores for said first sensor unit, each sub-risk score of the plurality of sub-risk scores corresponding to a risk factor;

compute a risk score for said first sensor unit based on the computed sub-risk scores; and determine that a first alert condition is present for said first sensor unit in response to the risk score being greater than a threshold risk score.

2. The system of claim 1, wherein said at least one sensor unit further comprises a wearable device, and wherein said plurality of sensors are configured to be attached to said wearable device.

3. The system of claim 2, wherein said at least one sensor unit further comprises a loudspeaker attached to said wearable device, and wherein said at least one processor is further configured to cause said loudspeaker to generate an audio notification based on the determination that the first alert condition is present.

4. The system of claim 2, wherein said at least one sensor unit further comprises a display screen, and wherein said at least one processor is further configured to cause said display screen to display a notification based on the determination that an alert condition is present.

5. The system of claim 4, wherein said at least one processor is further configured to cause said display screen to display the risk score and the plurality of sub-risk scores.

6. The system of claim 1, wherein said plurality of sensors comprises at least one of a camera, a gas sensor, a temperature sensor, a humidity sensor, a voltage sensor, an electric field sensor, a sound sensor, a pressure sensor, and a biometric sensor.

7. The system of claim 1, wherein said at least one processor is further configured to determine that a second alert condition is present in response to a first sub-risk score of the plurality of sub-risk scores being greater than a threshold sub-risk score.

8. The system of claim 1, wherein said at least one processor is further configured to compute an average risk score over time based on the computed risk score.

9. The system of claim 8, wherein said at least one processor is further configured to determine that a second alert condition is present based on the computed risk score deviating from the average risk score by greater than a threshold deviation.

10. A method for generating hazard alerts, said method performed by a hazard analysis (HA) computing device including at least one processor coupled to at least one memory device and further coupled to a plurality of sensor units each including a plurality of sensors and a locating device, said method comprising:

receiving, by the at least one processor from the plurality of sensors of each of the plurality of sensor units, a plurality of sensor measurements;

receiving, by the at least one processor from the locating device a first sensor unit of the plurality of sensor units, a plurality of sensor locations;

determining, by the at least one processor, based on the received sensor locations, a location of the first sensor unit during each sensor measurement of the plurality of sensor measurements;

computing, by the at least one processor, based on the plurality of sensor measurements received from each of the plurality of sensor units and the determined locations for the first sensor unit, a plurality of sub-risk scores for the first sensor unit, each sub-risk score of the plurality of sub-risk scores corresponding to a risk factor;

computing, by the at least one processor, a risk score for the first sensor unit based on the computed sub-risk scores; and determining, by the at least one processor, that a first alert condition is present for the first sensor unit in response to the risk score being greater than a threshold risk score.

11. The method of claim 10, wherein the at least one sensor unit further includes a wearable device, and wherein the plurality of sensors are configured to be attached to the wearable device.

12. The method of claim 11, wherein the at least one sensor unit further includes a loudspeaker attached to the wearable device, and wherein said method further comprises causing, by the at least one processor, the loudspeaker to generate an audio notification based on the determination that the first alert condition is present.

13. The method of claim 11, wherein the at least one sensor unit further includes a display screen, and wherein said method further comprises causing, by the at least one processor, the display screen to display a notification based on the determination that an alert condition is present.

14. The method of claim 13, further comprising causing, by the at least one processor, the display screen to display the risk score and the plurality of sub-risk scores.

15. The method of claim 10, further comprising determining, by the at least one processor, that a second alert condition is present in response to a first sub-risk score of the plurality of sub-risk scores being greater than a threshold sub-risk score.

16. The method of claim 10, further comprising computing, by the at least one processor, an average risk score over time based on the computed risk score.

17. The method of claim 16, further comprising determining, by the at least one processor, that a second alert condition is present based on the computed risk score deviating from the average risk score by greater than a threshold deviation.

18. A hazard analysis (HA) computing device comprising at least one processor coupled to at least one memory device, said HA computing device configured to communicate with a plurality of sensor units each including a plurality of sensors and a locating device, said at least one processor configured to:

receive, from the plurality of sensors of each of the plurality of sensor units, a plurality of sensor measurements;

receive, from the locating device of a first sensor unit of the plurality of sensor units, a plurality of sensor locations;

determine, based on the received sensor locations each sensor a location of the first sensor unit during each sensor measurement of the plurality of sensor measurements;

compute, based on the plurality of sensor measurements received from each of the plurality of sensor units and the determined locations for the first sensor unit, a plurality of sub-risk scores for the first sensor unit, each sub-risk score of the plurality of sub-risk scores corresponding to a risk factor;

compute a risk score for the first sensor unit based on the computed sub-risk scores; and determine that a first alert condition is present for the first sensor unit in response to the risk score being greater than a threshold risk score.

19. The HA computing device of claim 18, wherein the at least one sensor unit further includes a wearable device, and wherein the plurality of sensors are configured to be attached to the wearable device.

20. The HA computing device of claim 19, wherein the at least one sensor unit further includes a display screen, and wherein said at least one processor is further configured to cause the display screen to display a notification based on the determination that the first alert condition is present.

* * * * *